US010576343B2

(12) United States Patent
Jaw

(10) Patent No.: US 10,576,343 B2
(45) Date of Patent: Mar. 3, 2020

(54) SLIP-PROOF GRIP COVERING AND METHOD FOR MAKING THE SAME

(71) Applicant: Leo Jaw, Taichung (TW)

(72) Inventor: Leo Jaw, Taichung (TW)

( * ) Notice: Subject to any disclaimer, the term of this patent is extended or adjusted under 35 U.S.C. 154(b) by 0 days.

(21) Appl. No.: 16/140,666

(22) Filed: Sep. 25, 2018

(65) Prior Publication Data

US 2019/0022486 A1 Jan. 24, 2019

Related U.S. Application Data

(63) Continuation-in-part of application No. 15/822,421, filed on Nov. 27, 2017, now Pat. No. 10,183,205.

(30) Foreign Application Priority Data

Apr. 14, 2017 (TW) ..... 106112676 A

(51) Int. Cl.

| | |
|---|---|
| ***A63B 53/14*** | (2015.01) |
| ***A63B 60/14*** | (2015.01) |
| ***A63B 60/16*** | (2015.01) |
| *A63B 60/08* | (2015.01) |
| *A63B 102/02* | (2015.01) |
| *A63B 102/32* | (2015.01) |

(52) U.S. Cl.

CPC ..... *A63B 60/14* (2015.10); *A63B 60/16* (2015.10); *A63B 60/08* (2015.10); *A63B 2102/02* (2015.10); *A63B 2102/32* (2015.10); *A63B 2209/00* (2013.01)

(58) Field of Classification Search

CPC ..... A63B 60/14; A63B 60/16; A63B 49/08; A63B 53/14; A63B 2102/32; A63B 2209/00; A63B 60/08; A63B 2102/02

See application file for complete search history.

(56) References Cited

U.S. PATENT DOCUMENTS

| | | | | |
|---|---|---|---|---|
| 1,890,037 A * | 12/1932 | Johnson | ..... | A63B 53/14 473/300 |
| 2,050,176 A | 8/1936 | Hammerich | | |
| 3,311,375 A * | 3/1967 | Onions | ..... | A63B 53/14 473/301 |
| 3,366,384 A * | 1/1968 | Lamkin | ..... | A63B 49/08 473/300 |
| 5,890,972 A | 4/1999 | Huang | | |

(Continued)

FOREIGN PATENT DOCUMENTS

| | | |
|---|---|---|
| TW | 338334 U | 8/1998 |
| TW | I314466 B | 9/2009 |

*Primary Examiner* — Stephen L Blau

(74) *Attorney, Agent, or Firm* — Alan D. Kamrath; Karin L. Williams; Mayer & Williams PC

(57) ABSTRACT

A slip-proof grip covering includes a slip-proof tape that has a rear end and a front end and that includes a gripping portion between the rear end and the front end and a first and second folding portion adjacent to the rear end. The first folding portion is folded to the second folding portion. The first folding portion has a first side and a second side opposite to the first side and the second folding portion includes a first side attached to the second side of the first folding portion and a second side contiguous and adjacent to the gripping portion. Each of a thickness of the first folding portion and a thickness of the second folding portion is not thicker than a thickness of the gripping portion.

5 Claims, 14 Drawing Sheets

(56) References Cited

U.S. PATENT DOCUMENTS

| | | | | |
|---|---|---|---|---|
| 6,641,488 | B2 | 11/2003 | Huang | |
| 6,815,028 | B2 | 11/2004 | Huang | |
| 7,195,566 | B2 | 3/2007 | Chang | |
| 8,226,497 | B2 * | 7/2012 | Chu | A63B 53/14 473/300 |
| 8,480,508 | B2 | 7/2013 | Chu et al. | |
| 9,358,437 | B2 | 6/2016 | Ehlers | |
| 9,375,833 | B2 | 6/2016 | Huang | |
| 9,440,128 | B2 | 9/2016 | Huang | |
| 9,661,833 | B2 * | 5/2017 | Huang | A01K 87/08 |
| 2001/0046905 | A1 | 11/2001 | Huang | |
| 2003/0215629 | A1 | 11/2003 | Chen | |
| 2004/0029645 | A1 | 2/2004 | Chen | |
| 2005/0079924 | A1 | 4/2005 | Heinecke | |
| 2007/0015599 | A1 | 1/2007 | Yang | |
| 2009/0268992 | A1 | 10/2009 | Brouwer | |
| 2012/0124739 | A1 | 5/2012 | Crowne et al. | |
| 2012/0283035 | A1 | 11/2012 | Wang | |
| 2013/0284363 | A1 * | 10/2013 | Huang | A01K 87/08 156/293 |
| 2015/0196814 | A1 * | 7/2015 | Chu | A63B 53/14 473/300 |
| 2016/0257065 | A1 | 9/2016 | Moreau et al. | |
| 2016/0287958 | A1 | 10/2016 | Wang | |

* cited by examiner

SLIP-PROOF GRIP COVERING AND METHOD FOR MAKING THE SAME

CROSS REFERENCE TO RELATED APPLICATION

The present application is a continuation-in-part application of U.S. patent application Ser. No. 15/822,421 filed on Nov. 27, 2017.

BACKGROUND OF THE INVENTION

The present invention relates to a grip covering and, more particularly, to a slip-proof grip covering and a method for making the slip-proof grip covering.

U.S. Pat. No. 8,480,508 (CN Patent Application No. 201210348141.3) discloses a golf club grip including a resilient inner sleeve, a single sheet, an axial seam strip, and a combination of adhesives. The single sheet is wrapped around and adhered onto the resilient inner sleeve's body and has its top and bottom circumferential margins respectively over the resilient inner sleeve's cap underside edge and retaining sidewall edge, and two axial margins forming an axial gap along the length of the resilient inner sleeve's body. The combination of adhesives includes a pressure sensitive adhesive and a structural adhesive. The pressure sensitive adhesive is used to adhere the single sheet onto the resilient inner sleeve's body. The structural adhesive is applied in the axial gap covered with the axial seam strip to form an axial seam structure.

However, a sealing action must be carried out after the single sheet is adhered onto the resilient inner sleeve's body. This sealing action includes use of a rigid plate-like member (such as a body of a butter knife) to insert a margin of the single sheet adjacent to the cap into a gap between the tubular body and the cap, thereby avoiding generation of burrs at the margin of the single sheet and exposure of the burrs.

In addition to adhering after wrapping the tubular body with the single sheet, another approach is rolling a piece of leather into a tubular shape, sewing the tubular shape into a leather tube, and slipping the sewed leather tube to a position around a shaft.

U.S. Pat. No. 3,366,384 entitled "GOLF CLUB GRIP AND METHOD FOR MAKING SAME" discloses a method for applying a leather golf club grip to a golf club shaft includes the steps of affixing an underlisting to the grip end of the golf club shaft, forming a leather gripping surface for the underlisting by skiving a single piece of leather to form a bevel along two of its edges and forming the piece of leather into a tubular shape by sewing the two skived edges together, the edges projecting inwardly toward the interior thereof, and applying the leather gripping surface to the underlisting, by slipping it over the club head end of the shaft and onto the underlisting prior to affixing the club head to the shaft. A cap is mounted to an end of the shaft and includes a conic surface abutting the bevel of the piece of leather and corresponding to the inclined surface of the shaft.

However, when using the above structure to make the golf club grip, the piece of leather must be trimmed before coupling the cap to the end of the shaft. Otherwise, the piece of leather will still be uneven, and the structure of the shaft and the cap are complicated.

Furthermore, after a long period of use and application of forces on the golf club grips formed by the above two methods, the adherence effect deteriorates, such that the margin of the single piece and the bevel of the piece of leather are apt to disengage from the resilient inner sleeve and the underlisting, respectively. Thus, the margin of the single piece and the bevel of the piece of leather are exposed, and burrs are formed.

Thus, a need exists for a novel slip-proof grip covering and a method for making the slip-proof grip covering to overcome the disadvantages of the above conventional structures.

BRIEF SUMMARY OF THE INVENTION

A slip-proof grip covering in one embodiment of the present invention includes a lining tube and a slip-proof tape mounted on an outer periphery of the lining tube. The slip-proof tape has an inner face and an outer face opposite to the inner face. The slip-proof tape has a rear end and a front end opposite to the rear end. The slip-proof tape includes a gripping portion between the rear end and the front end. The slip-proof tape includes a first and second folding portion adjacent to the rear end. The first folding portion has a first side and a second side opposite to the first side and the second folding portion includes a first side attached to the second side of the first folding portion and a second side contiguous and adjacent to the gripping portion. Each of a thickness of the first folding portion and a thickness of the second folding portion is not thicker than a thickness of the gripping portion. The first folding portion and the second folding portion overlap with each other. The slip-proof tape includes a third and fourth folding portion adjacent to the front end. Each of a thickness of the third folding portion and a thickness of the fourth folding portion is not thicker than the thickness of the gripping portion. The third folding portion is folded in the direction toward inner face. The third folding portion and the fourth folding portion overlap with each other.

A slip-proof grip covering in another embodiment of the present invention includes a slip-proof tape that has a rear end and a front end and that includes a gripping portion between the rear end and the front end and a first and second folding portion adjacent to the rear end. The first folding portion is folded to the second folding portion. The first folding portion has a first side and a second side opposite to the first side and the second folding portion includes a first side attached to the second side of the first folding portion and a second side contiguous and adjacent to the gripping portion. Each of a thickness of the first folding portion and a thickness of the second folding portion is not thicker than a thickness of the gripping portion.

In an example, the first folding portion and the second folding portion are glued together by glue disposed therebetween, and the third folding portion and the fourth folding portion are glued together by glue therebetween.

In an example, the first folding portion and the second folding portion are contiguous to each other. The first folding portion is folded to the second folding portion in the direction toward the inner face. The third folding portion and the fourth folding portion are contiguous to each other. The third folding portion is folded to the fourth folding portion in the direction toward the inner face.

In an example, the lining tube is a hollow cylindrical tube. A rear cap is mounted to an end of the lining tube. A ring is mounted to another end of the lining tube opposite to the rear cap. The slip-proof tape is rolled to form a cylindrical tube. The inner face faces inward. Two opposite sides of the slip-proof tape are connected to each other. The rear end of the slip-proof tape abuts the rear cap by the outer face. The rear end of the slip-proof tape does not overlap with the rear cap. The front end of the slip-proof tape abuts the ring by the outer face. The front end of the slip-proof tape does not overlap with the ring.

In an example, a maximum width of the rear cap in a diametric direction is larger than a maximum width of the lining tube in the diametric direction. A maximum width of the ring in the diametric direction is larger than the maximum width of the lining tube in the diametric direction. A maximum width of the rear end of the slip-proof tape in the diametric direction is smaller than the maximum width of the rear cap in the diametric direction. A maximum width of the front end of the slip-proof tape in the diametric direction is smaller than the maximum width of the ring in the diametric direction.

A method for making a slip-proof grip covering according to the present invention includes:

preparing a slip-proof tape, wherein the slip-proof tape includes an inner face and an outer face opposite to the inner face, wherein the slip-proof tape further includes a rear end and a front end opposite to the rear end, and wherein the slip-proof tape further includes a gripping portion between the rear end and the front end;

skiving the slip-proof tape at the rear end of the slip-proof tape to form the first folding portion 36 and the second folding portion, wherein each of a thickness of the first folding portion and a thickness of the second folding portion is not thicker than a thickness of the gripping portion;

skiving the slip-proof tape at the front end of the slip-proof tape to form the third folding portion and the fourth folding portion, wherein each of a thickness of the third folding portion and a thickness of the fourth folding portion is not thicker than the thickness of the gripping portion;

applying glue to at least one of a side of the first folding portion adjacent to the inner face and a side of the second folding portion adjacent to the inner face, and to at least one of a side of the third folding portion adjacent to the inner face and a side of the fourth folding portion adjacent to the inner face; and folding the first folding portion in a direction toward the inner face to overlap the first folding portion with the second folding portion and the third folding portion in the direction toward inner face to overlap the third folding portion with the fourth folding portion.

In an example, the method further includes rolling the slip-proof tape into a tube, with the inner face forming an inner periphery of the tube, with two opposite sides of the slip-proof tape interconnected to each other.

In an example, the method further includes an assembling step including mounting a rear cap to an end of the lining tube; mounting a ring to another end of the lining tube opposite to the rear cap, wherein the lining tube, the rear cap and the ring are an integrated structure; and mounting the slip-proof tape around an outer periphery of the lining tube, with the rear end of the slip-proof tape abutting the rear cap by the outer face, and with the front end of the slip-proof tape abutting the ring by the outer face.

In an example, in the assembling step the lining tube is a hollow cylindrical tube. A maximum width of the rear cap in a diametric direction is larger than a maximum width of the lining tube in the diametric direction. A maximum width of the ring in the diametric direction is larger than the maximum width of the lining tube in the diametric direction. The rear end of the slip-proof tape does not overlap with the rear cap. The front end of the slip-proof tape does not overlap with the ring. A maximum width of the rear end of the slip-proof tape in the diametric direction is smaller than the maximum width of the rear cap in the axial direction. A maximum width of the front end of the slip-proof tape in the diametric direction is smaller than the maximum width of the ring in the diametric direction.

In an example, the first folding portion and the second folding portion are contiguous to each other. The third folding portion and the fourth folding portion are contiguous to each other. Folding includes folding the first folding portion to the second folding portion in the direction toward the inner face. Folding also includes folding the third folding portion to the fourth folding portion in the direction toward the inner face.

The present invention will become clearer in light of the following detailed description of illustrative embodiments of this invention described in connection with the drawings.

DETAILED DESCRIPTION OF THE INVENTION

Figure 1:
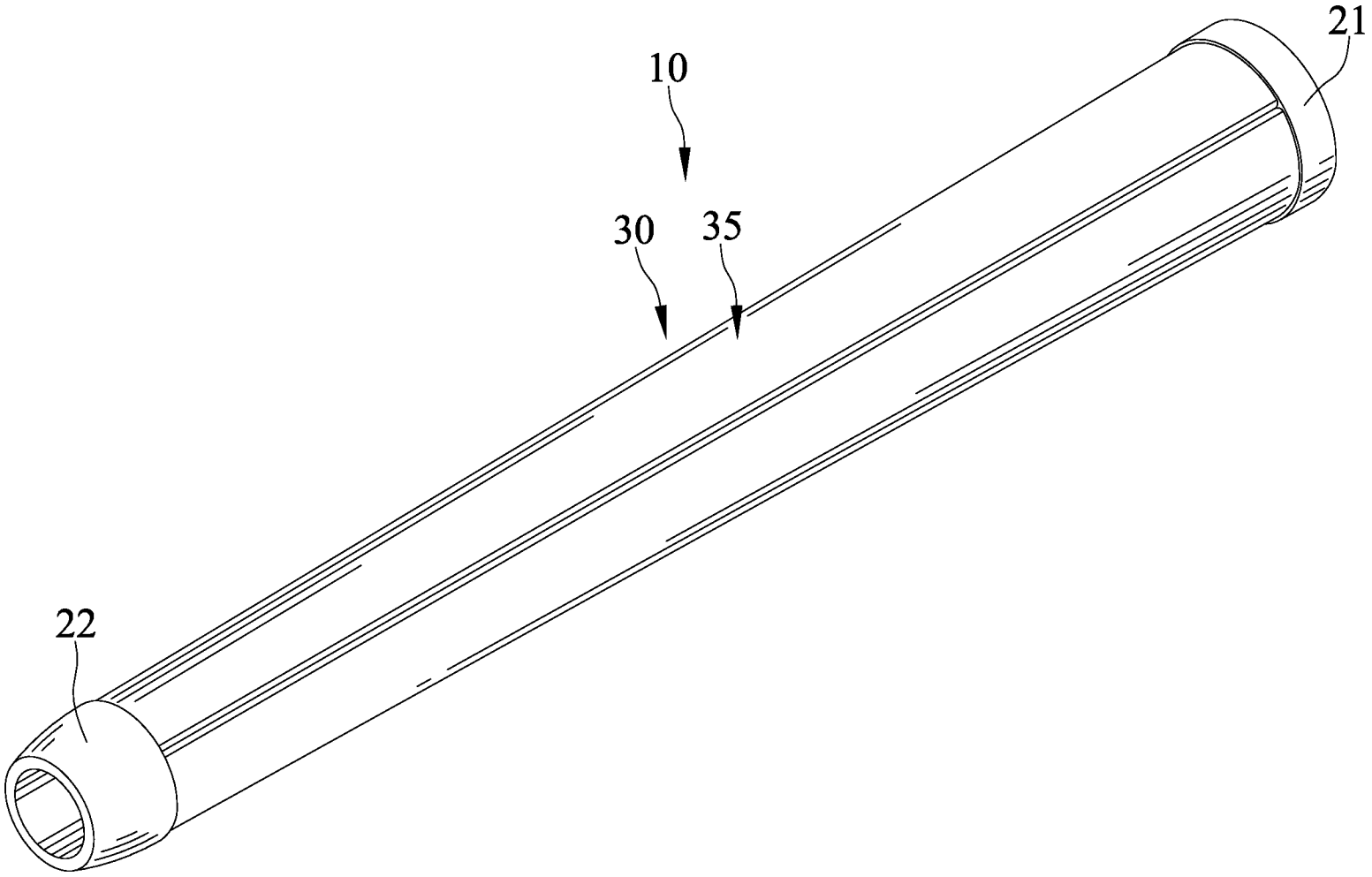
FIG. 1 is a perspective view of a slip-proof grip covering of an embodiment according to the present invention.
Figure 2:
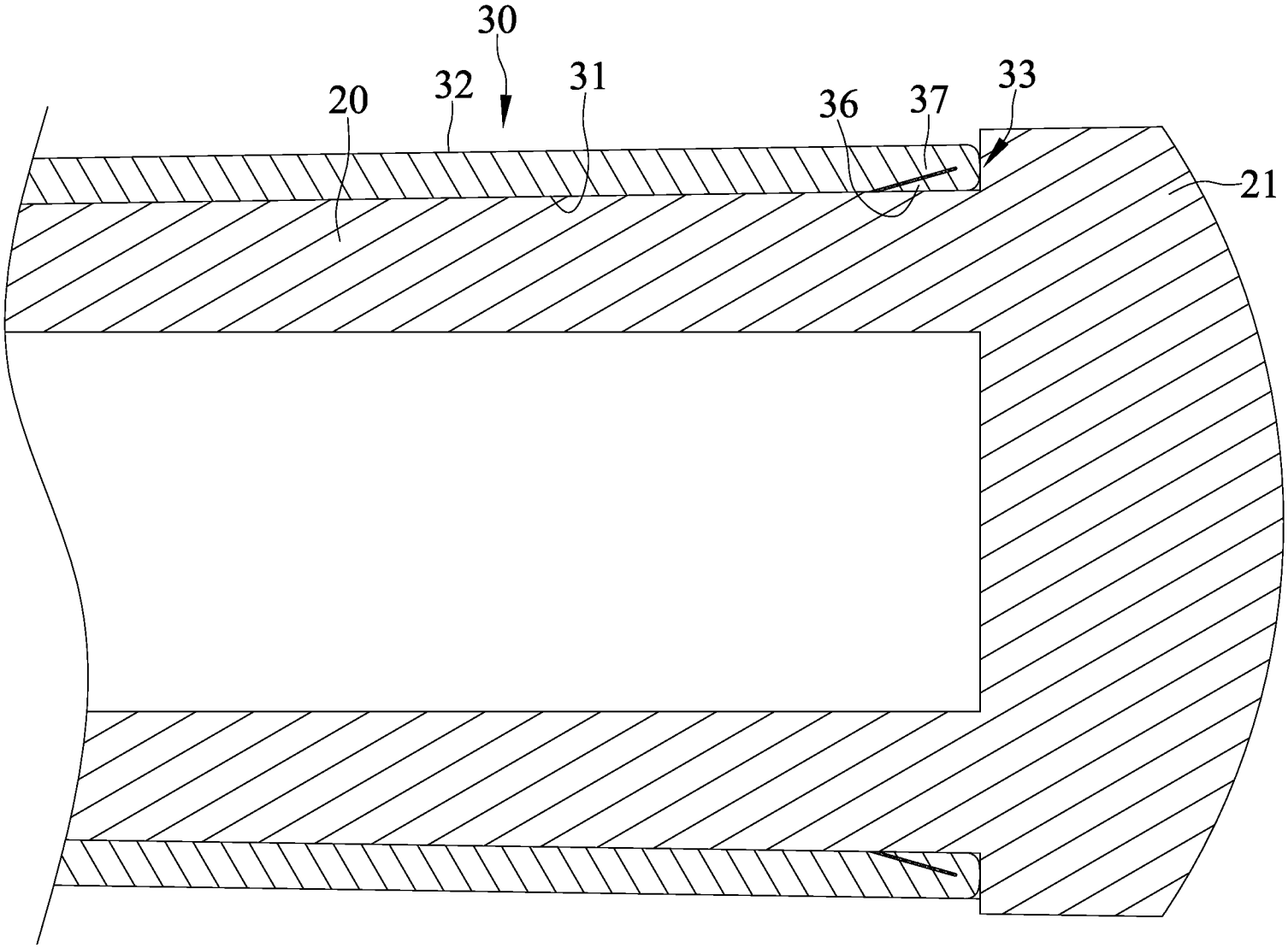
FIG. 2 is an enlarged, cross-sectional view of a rear end of the slip-proof grip covering of FIG. 1.
Figure 3:
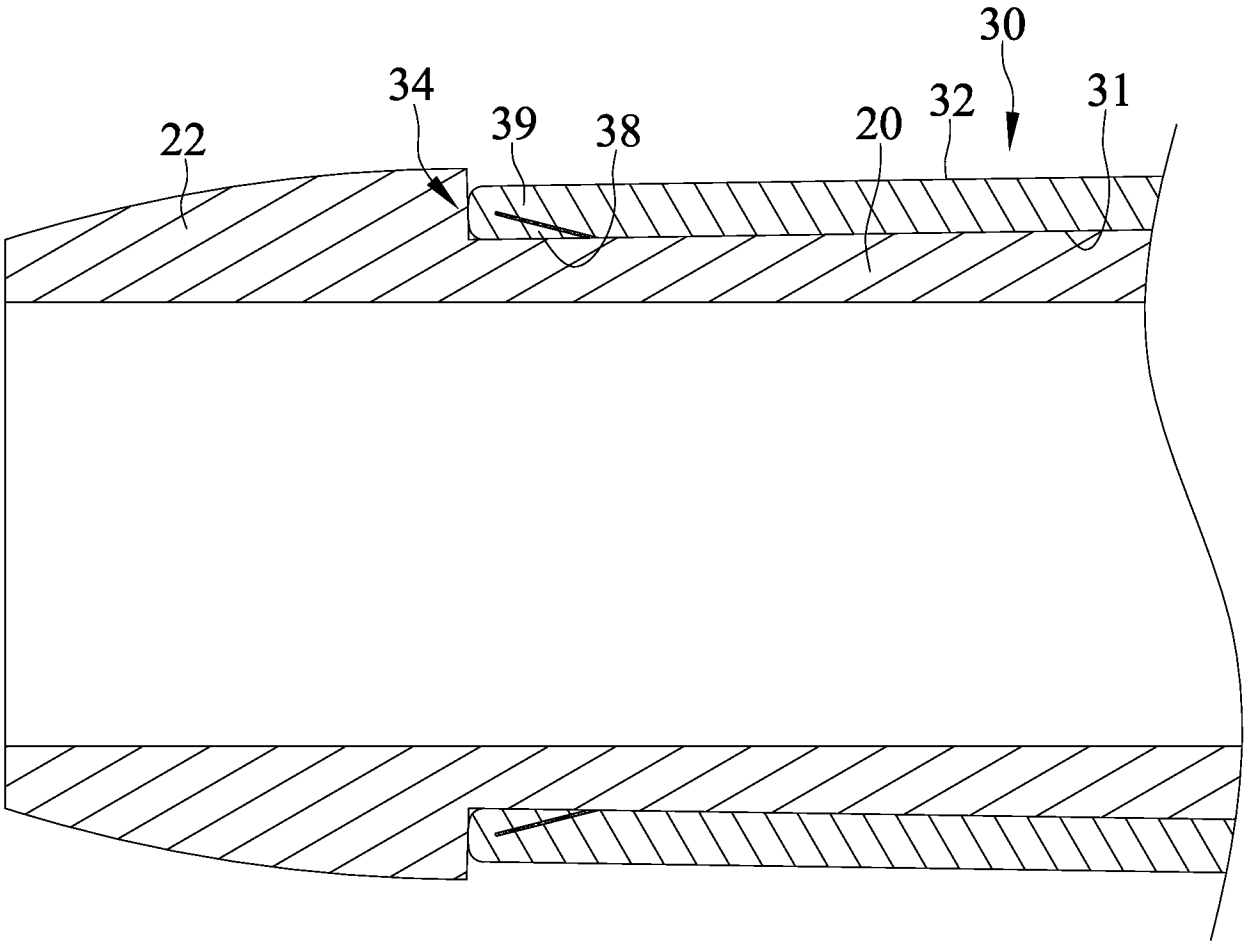
FIG. 3 is an enlarged, cross-sectional view of a front end of the slip-proof grip covering of FIG. 1.

With reference to FIGS. 1-3, a slip-proof grip covering 10 of an embodiment according to the present invention includes a lining tube 20 and a slip-proof tape 30.

The lining tube 20 is a hollow cylindrical tube. A rear cap 21 is mounted to an end of the lining tube 20. A maximum width of the rear cap 21 in a diametric direction is larger than a maximum width of the lining tube 20 in the diametric direction. A ring 22 is mounted to another end of the lining tube 20 opposite to the rear cap 21. A maximum width of the ring 22 in the diametric direction is larger than the maximum width of the lining tube 20 in the diametric direction. The lining tube 20, the rear cap 21 and the ring 22 are an integrated structure.

The slip-proof tape 30 is flexible and is adapted to be wrapped on a handle. The slip-proof tape 30 has an inner face 31 and an outer face 32 opposite to the inner face 31. The slip-proof tape 30 has a rear end 33 and a front end 34 opposite to the rear end 33. The slip-proof tape 30 includes a gripping portion 35 between the rear end 33 and the front end 34. A portion of the inner face 31 and a portion of the outer face 32 respectively form a first side and a second side of the gripping portion 35. The first side of the gripping portion 35 is opposite to the second side of the gripping portion 35. The portion of the inner face 31 is horizontal. The slip-proof tape 30 includes a first folding portion 36 and a second folding portion 37 adjacent to the rear end 33. The first folding portion 36 has a first side and a second side opposite to the first side. The second folding portion 37 includes a first side attached to the second side of the first folding portion 36 and a second side contiguous and adjacent to the gripping portion 35. The first side of the second folding portion 37 is opposite to the second side of the second folding portion 37. In the embodiment, the first folding portion 36 and the second folding portion 37 are glued together by glue disposed therebetween. The first side of the first folding portion 36 is horizontal. The first side of the second folding portion 37 and the second side of the first folding portion 36 are slanted. The first folding portion 36 and the second folding portion 37 are contiguous to each other. The first folding portion 36 includes an end contiguous to an end of the second folding portion 37. Each of a thickness of the first folding portion 36 and a thickness of the second folding portion 37 is not thicker than a thickness of the gripping portion 35. The thickness of the gripping portion 35 is measured from the inner face 31 to the outer face 32. The first and second folding portion 36 and 37 are formed on a first edge of the slip-proof tape and the first folding portion 36 is folded to the second folding portion 37. The first edge is slanted. The first folding portion 36 and the second folding portion 37 overlap with each other. The slip-proof tape 30 includes a third folding portion 38 and a fourth folding portion 39 adjacent to the front end 34. The third folding portion 38 has a first side and a second side opposite to the first side. The fourth folding portion 39 includes a first side attached to the second side of the third folding portion 38 and a second side contiguous and adjacent to the gripping portion 35. The first side of the fourth folding portion 39 is opposite to the second side of the fourth folding portion 39. In the embodiment, the third folding portion 38 and the fourth folding portion 39 are glued together by glue disposed therebetween. The first side of the third folding portion 38 is horizontal. The first side of the fourth folding portion 39 and the second side of the third folding portion 38 are slanted. The third folding portion 38 and the fourth folding portion 39 are contiguous to each other. The third folding portion 38 includes an end contiguous to an end of the fourth folding portion 39. Each of a thickness of the third folding portion 38 and a thickness of the fourth folding portion 39 is not thicker than the thickness of the gripping portion 35. The third and fourth folding portions 38 and 39 are formed on a second edge of the slip-proof tape 30 and the third folding portion 38 is folded to the fourth folding portion 39. formed. The second edge is slanted. The third folding portion 38 and the fourth folding portion 39 overlap with each other.

The slip-proof tape 30 is rolled to form a cylindrical tube with the inner face 31 facing inward and with two opposite sides of the slip-proof tape 30 connected to each other. The slip-proof tape 30 is mounted around an outer periphery of the lining tube 20. A portion of the outer face 32 forms the rear end 33 of the slip-proof tape 30. The rear end 33 of the slip-proof tape 30 abuts a distal end of the rear cap 21 by the outer face 32. The rear end 33 of the slip-proof tape 30 does not overlap with the rear cap 21. A maximum width of the rear end 33 of the slip-proof tape 30 in the diametric direction is smaller than the maximum width of the rear cap 21 in the diametric direction. A portion of the outer face 32 forms the front end 34 of the slip-proof tape 30. The front end 34 of the slip-proof tape 30 abuts a distal end of the ring 22 by the outer face 32. The front end 34 of the slip-proof tape 30 does not overlap with the ring 22. A maximum width of the front end 34 of the slip-proof tape 30 in the diametric direction is smaller than the maximum width of the ring 22 in the diametric direction.

Figure 4:
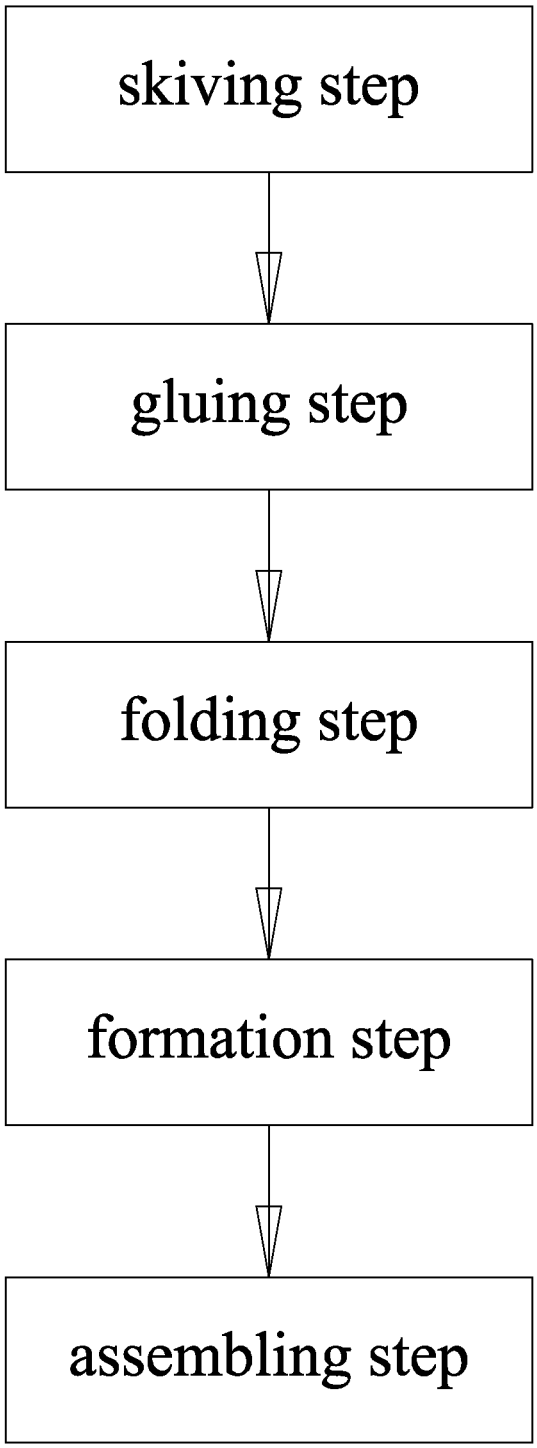
FIG. 4 is a flowchart illustrating a method for making a slip-proof grip covering according to the present invention.

With reference to FIG. 4, a method for making a slip-proof grip covering 10 includes a skiving step, a gluing step, a folding step, a formation step, and an assembling step.

Figure 5:
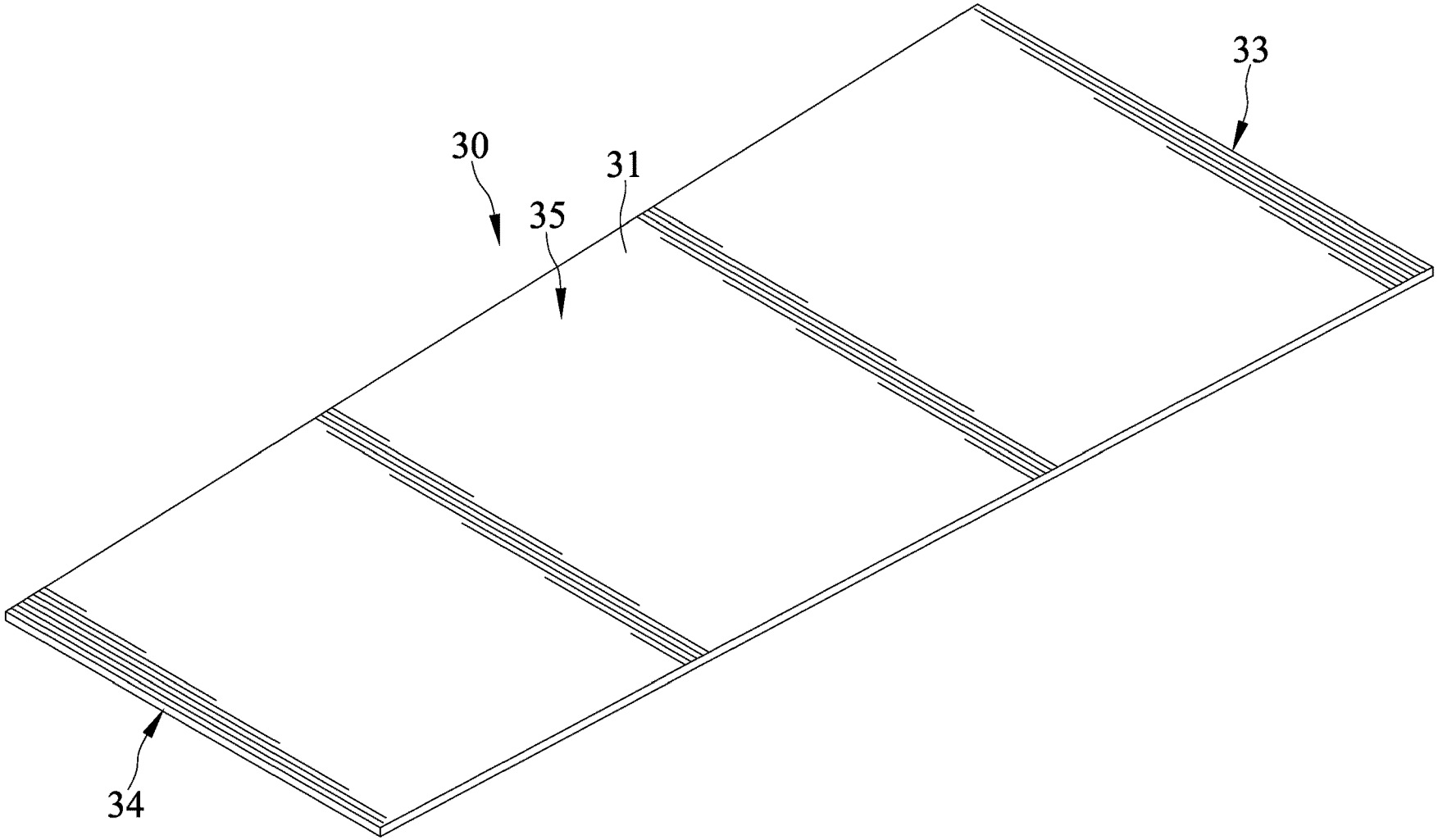
FIG. 5 is a perspective view illustrating a slip-proof piece before a skiving step and a gluing step of the method according to the present invention.
Figure 6:
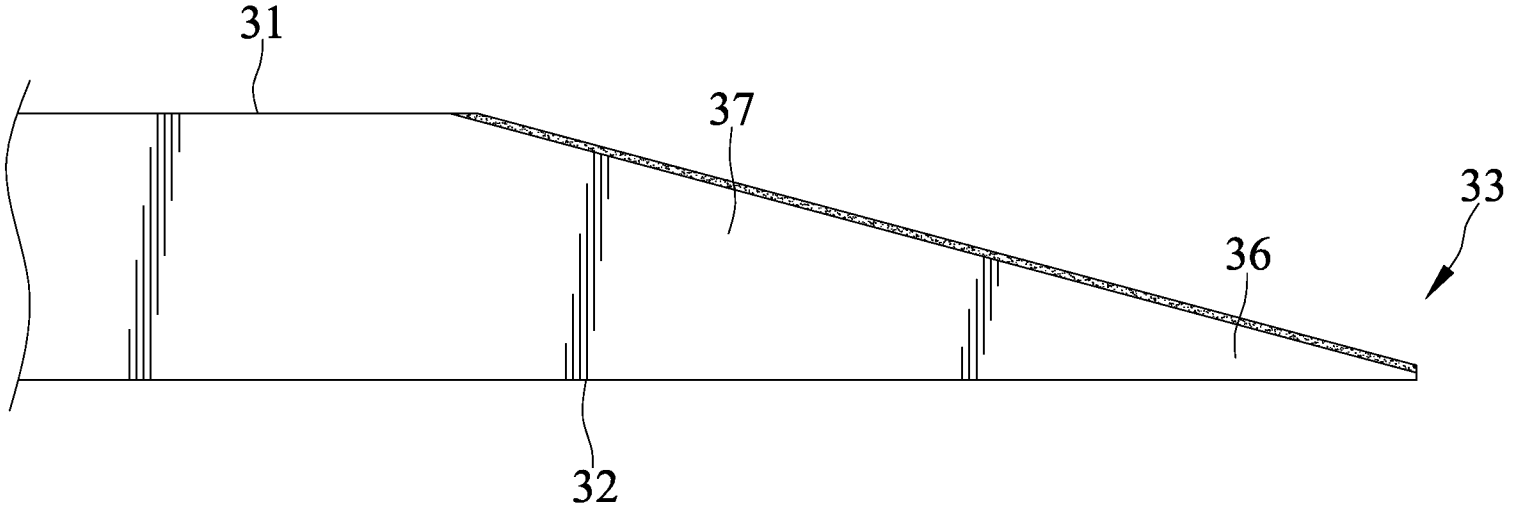
FIG. 6 is a partial, side view of the slip-proof piece of FIG. 5 after the skiving step and the gluing step.
Figure 7:
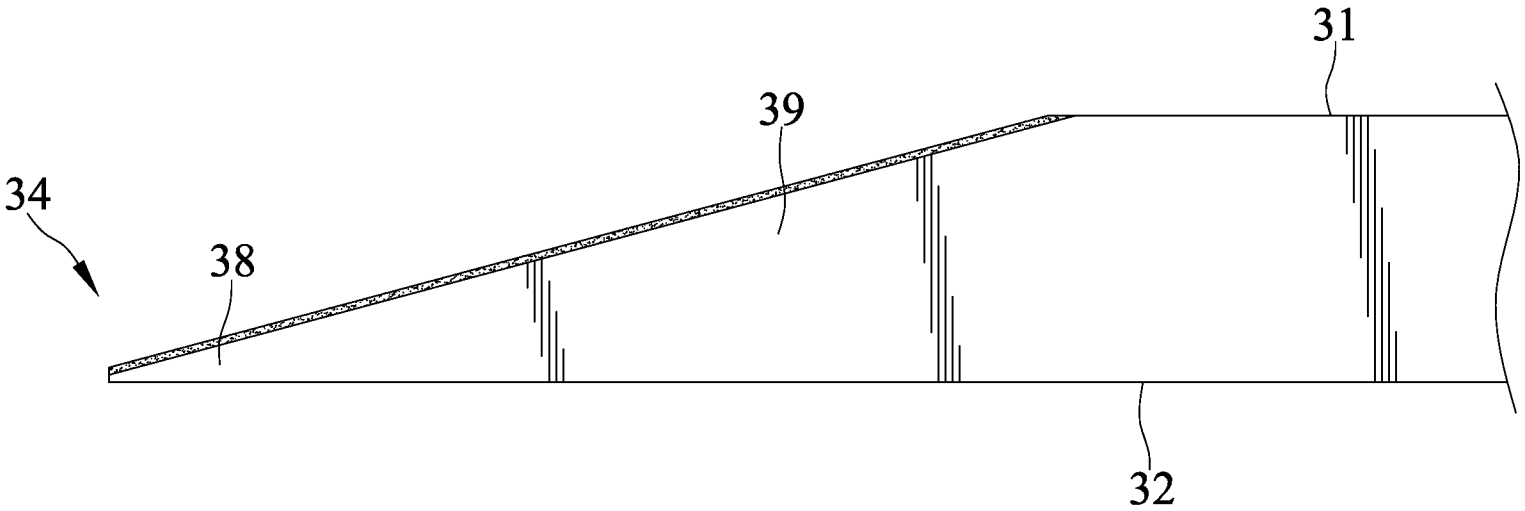
FIG. 7 is another partial, side view of the slip-proof piece of FIG. 5.

With reference to FIGS. 5-7, the slip-proof tape 30 is firstly prepared. The slip-proof tape 30 has the inner face 31 and the outer face 32 on opposite sides. The slip-proof tape 30 has the rear end 33 and the front end 34 on opposite ends. The slip-proof tape 30 includes a gripping portion 35 between the rear end 33 and the front end 34.

The skiving step includes skiving the slip-proof tape 30 at the rear end 33 of the slip-proof tape 30 to form the first folding portion 36 and the second folding portion 37. Each of a thickness of the first folding portion 36 and a thickness of the second folding portion 37 is not thicker than a thickness of the gripping portion 35. The first folding portion 36 and the second folding portion 37 are contiguous to each other. The second folding portion 37 extends between the first folding portion 36 and the gripping portion 35. The first folding portion 36 includes a slanted side. The second folding portion 37 includes a slanted side extending between the slanted side of the first folding portion 36 and the gripping portion 35. The skiving step also includes skiving the slip-proof tape 30 at the front end 34 of the slip-proof tape 30 to form the third folding portion 38 and the fourth folding portion 39. Each of a thickness of the third folding portion 38 and a thickness of the fourth folding portion 39 is not thicker than the thickness of the gripping portion 35. The third folding portion 38 and the fourth folding portion 39 are contiguous to each other. The fourth folding portion 39 extends between the third folding portion 38 and the gripping portion 35. The third folding portion 38 includes a slanted side. The fourth folding portion 39 includes a slanted side extending between the slanted side of the third folding portion 38 and the gripping portion 35.

The gluing step includes applying glue to the side of the first folding portion 36 which is slanted and is adjacent to the inner face 31 and to a side of the second folding portion 37 which is slanted and is adjacent to the inner face 31. The gluing step also includes applying glue to the side of the third folding portion 38 which is slanted and is adjacent to the inner face 31 and the side of the fourth folding portion 39 which is slanted and is adjacent to the inner face 31.

Figure 8:
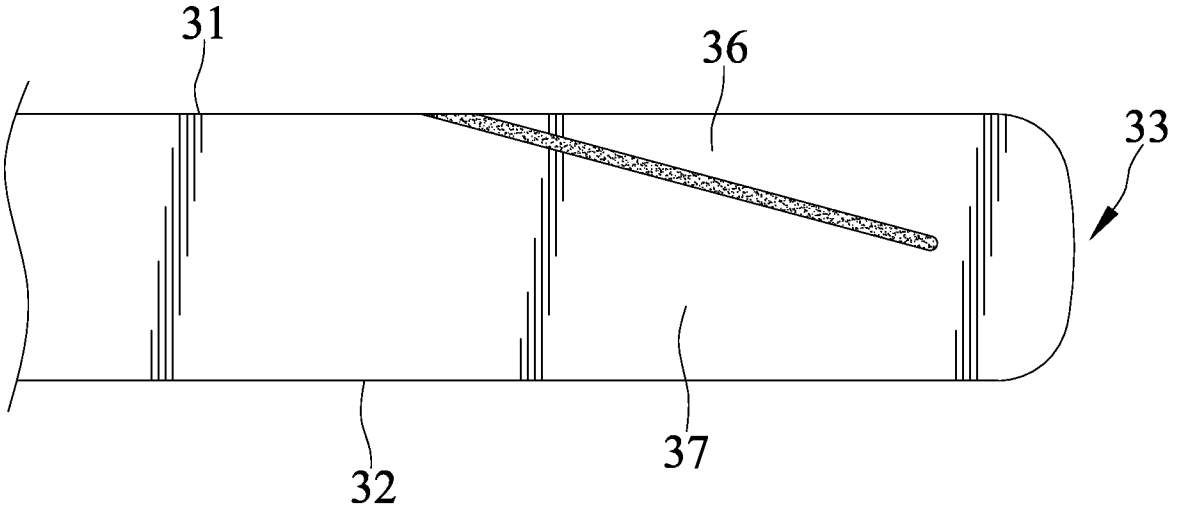
FIG. 8 is a partial, side view illustrating the slip-proof piece after a folding step.
Figure 9:
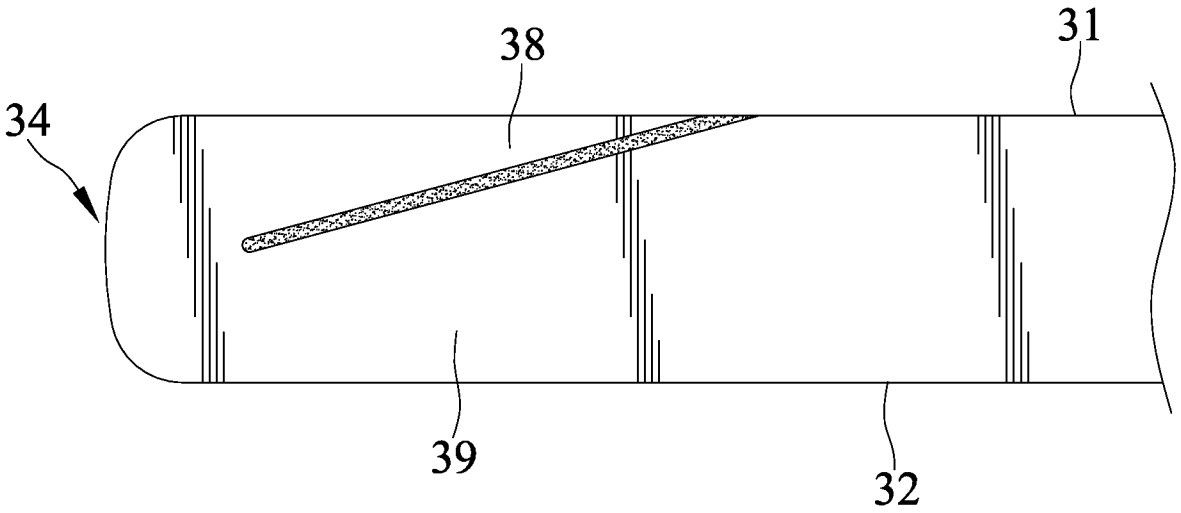
FIG. 9 is another partial, side view illustrating the slip-proof piece after a folding step.

With reference to FIGS. 8 and 9, the folding step includes folding the first folding portion 36 to the second folding portion 37 in a direction toward the inner face 31 to overlap the first folding portion 36 with the second folding portion 37. The folding step also includes folding the third folding portion 38 to the fourth folding portion 39 in the direction toward inner face 31 to overlap the third folding portion 38 with the fourth folding portion 39.

Figure 10:
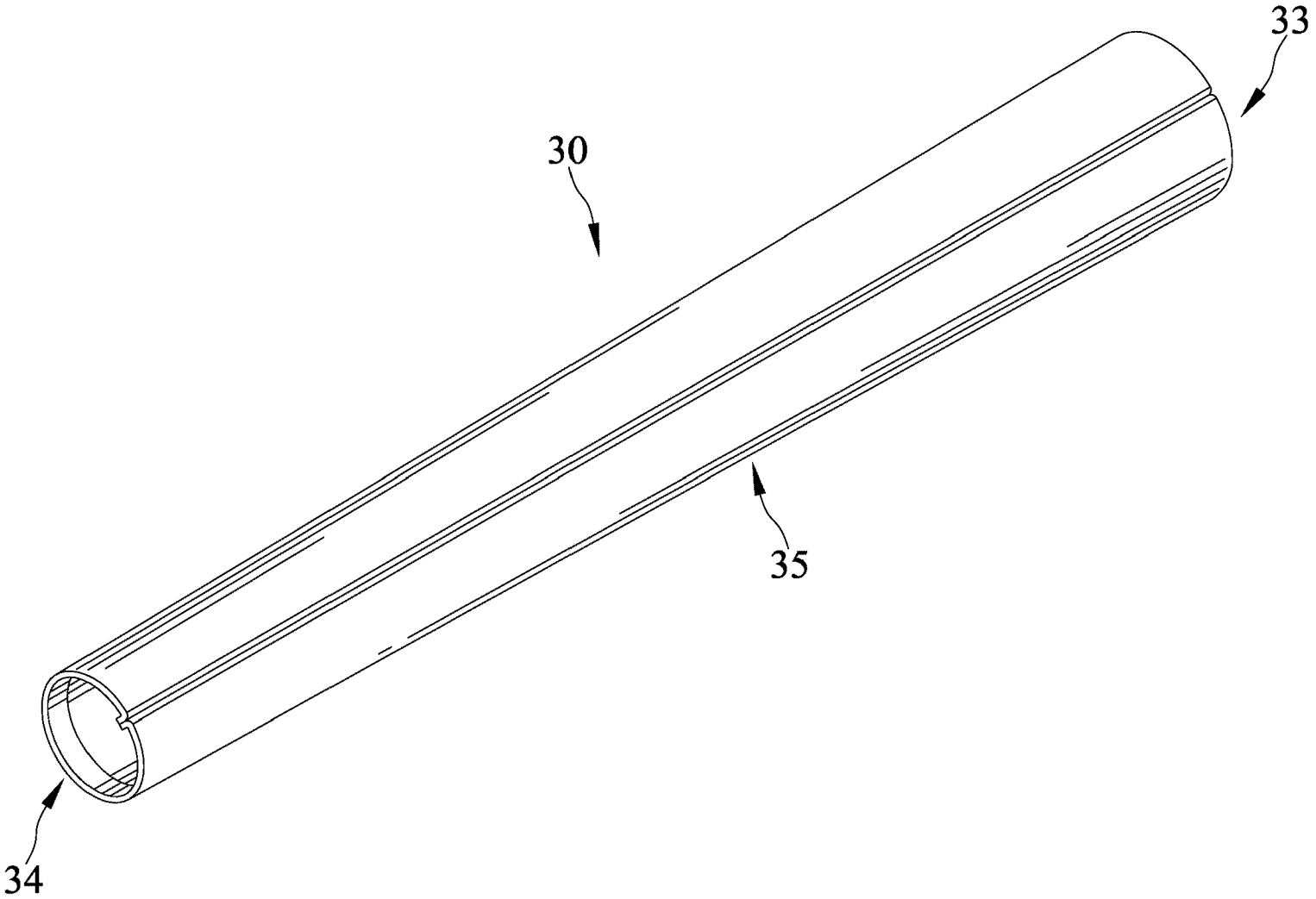
FIG. 10 is a perspective view of the slip-proof piece after a formation step.
Figure 11:
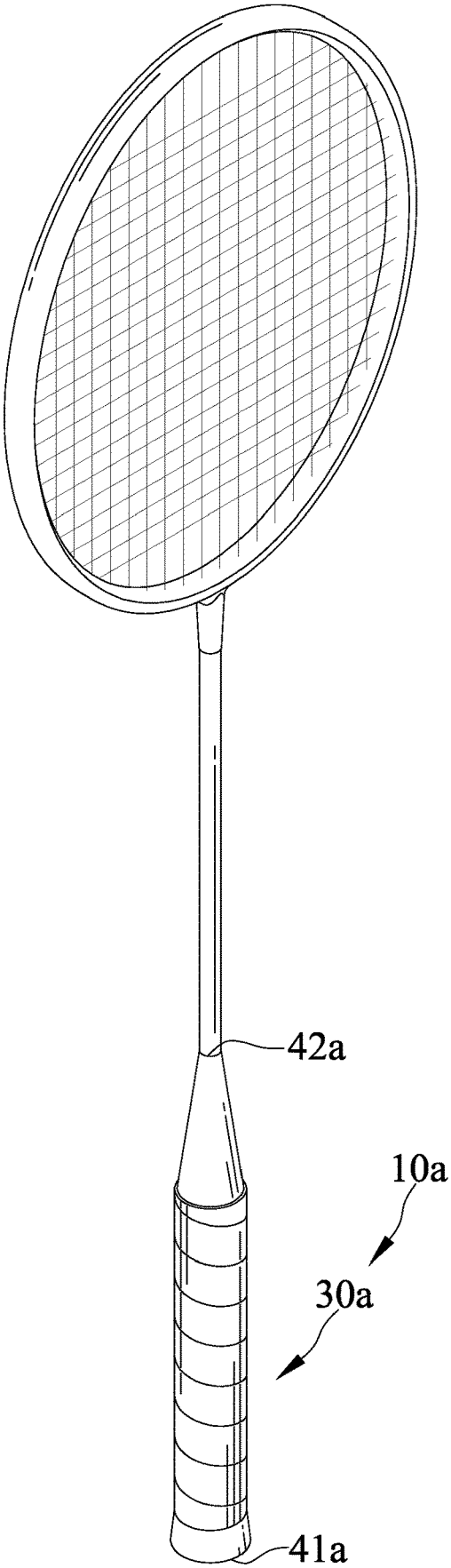
FIG. 11 is a perspective view showing a slip-proof grip covering of another embodiment according to the present invention wrapped on a racket.
Figure 12:
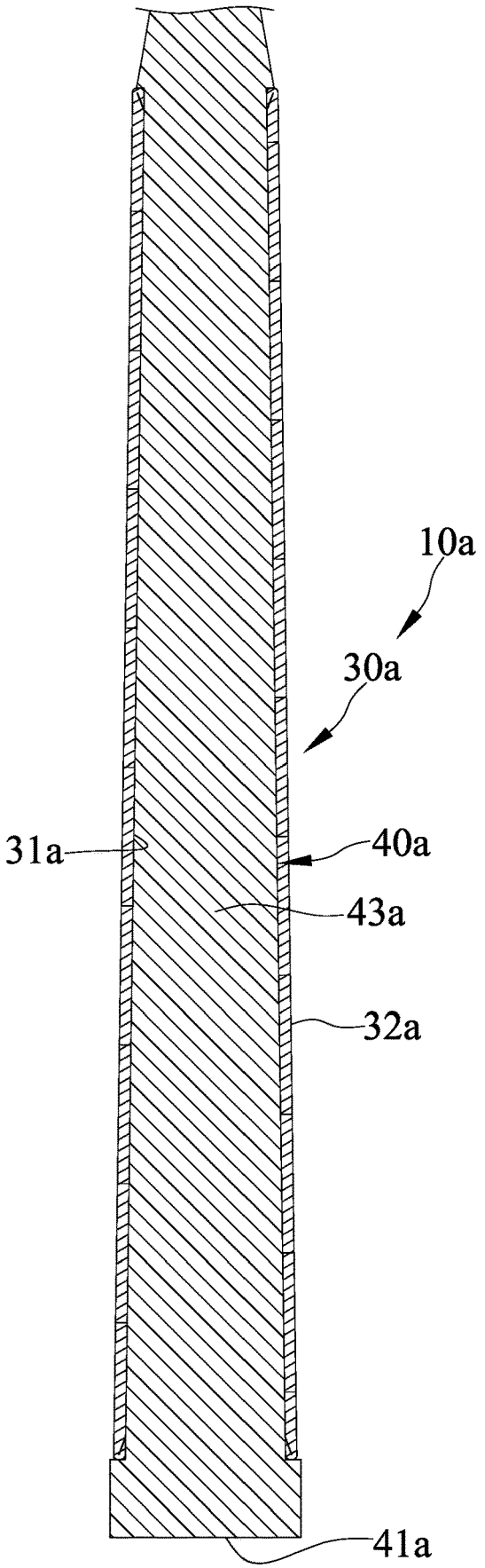
FIG. 12 is a cross-sectional view of FIG. 11.
Figure 13:
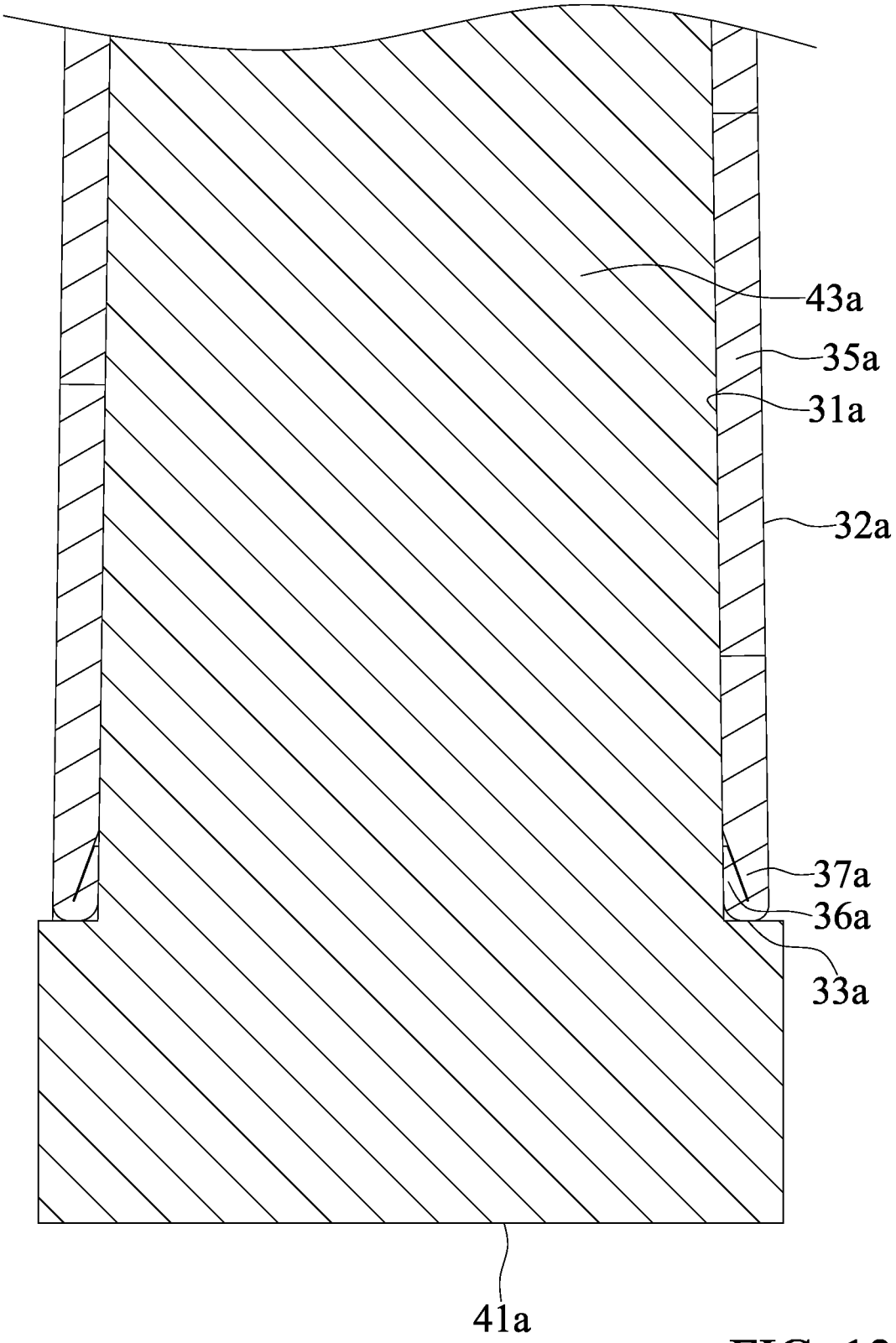
FIG. 13 is an enlarged, cross-sectional view of FIG. 12.
Figure 14:
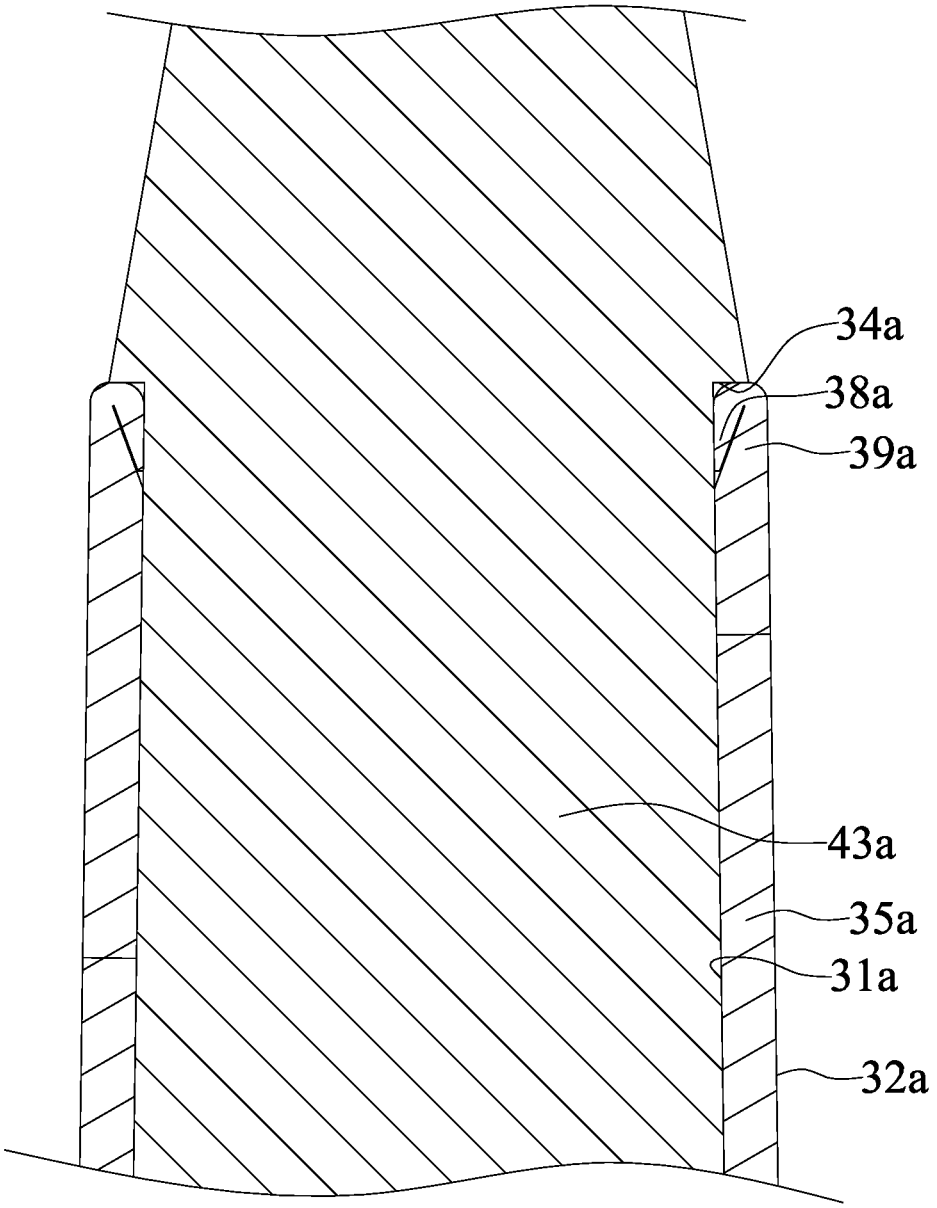
FIG. 14 is another enlarged, cross-sectional view of FIG. 12.

With reference to FIG. 10, the formation step includes rolling the slip-proof tape 30 into a tube, with the inner face 31 forming an inner periphery of the tube, and with two opposite sides of the slip-proof tape 30 interconnected to each other.

The assembling step includes mounting a rear cap 21 to an end of the lining tube 20 (see FIGS. 2 and 3) and mounting a ring 22 to another end of the lining tube 20 (See FIG. 3). The ring 22 is opposite to the rear cap 21. The rear cap 21 and the ring 22 are an integrated structure. The slip-proof tape 30 is mounted around an outer periphery of the lining tube 20 with the rear end 33 of the slip-proof tape 30 abutting the rear cap 21 by the outer face 32 and with the front end 34 of the slip-proof tape 30 abutting the ring 22 by the outer face 32.

With reference to FIGS. 11-14, a slip-proof grip covering 10*a* of another embodiment according to the present invention is wrapped on a racket 40*a*. The slip-proof grip covering 10*a* includes a slip-proof tape 30*a* and the slip-proof tape 30*a* is wrapped directly on the racket 40*a*. The racket 40*a* has a rear end 41*a*, a front end 42*a*, and a middle 43*a* between the rear and front ends 41*a* and 42*a*. The slip-proof tape 30*a* is spirally wrapped on the middle 43*a* of the racket 40*a*.

The slip-proof tape 30*a* is flexible and is adapted to be wrapped on a handle. The slip-proof tape 30*a* is similar to the slip-proof tape 30. The slip-proof tape 30*a* has an inner face 31*a* and an outer face 32*a* opposite to the inner face 31*a*. The slip-proof tape 30 has a rear end 33*a* and a front end 34*a* opposite to the rear end 33*a*. The slip-proof tape 30*a* includes a gripping portion 35*a* between the rear end 33*a* and the front end 34*a*. A portion of the inner face 31*a* and a portion of the outer face 32*a* respectively form a first side and a second side of the gripping portion 35*a*. The first side of the gripping portion 35*a* is opposite to the second side of the gripping portion 35*a*. The portion of the inner face 31*a* is horizontal. The slip-proof tape 30*a* includes a first folding portion 36*a* and a second folding portion 37*a* adjacent to the rear end 33*a*. The first folding portion 36*a* is folded to the second folding portion 37*a*. The first folding portion 36*a* has a first side and a second side opposite to the first side. The second folding portion 37*a* includes a first side attached to the second side of the first folding portion 36*a* and a second side contiguous and adjacent to the gripping portion 35*a*. The first side of the second folding portion 37*a* is opposite to the second side of the second folding portion 37*a*. In the embodiment, the first folding portion 36*a* and the second folding portion 37*a* are glued together by glue disposed therebetween. The first side of the first folding portion 36*a* is horizontal. The first side of the second folding portion 37*a* and the second side of the first folding portion 36*a* are slanted. The first folding portion 36*a* and the second folding portion 37*a* are contiguous to each other. The first folding portion 36*a* includes an end contiguous to an end of the second folding portion 37*a*. Each of a thickness of the first folding portion 36*a* and a thickness of the second folding portion 37*a* is not thicker than a thickness of the gripping portion 35*a*. The thickness of the gripping portion 35*a* is measured from the inner face 31*a* to the outer face 32*a*. The first folding portion 36*a* and the second folding portion 37*a* overlap with each other. The slip-proof tape 30*a* includes a third folding portion 38*a* and a fourth folding portion 39*a* adjacent to the front end 34*a*. The third folding portion 38*a* is folded to the fourth folding portion 39*a*. The third folding portion 38*a* has a first side and a second side opposite to the first side. The fourth folding portion 39*a* includes a first side attached to the second side of the third folding portion 38*a* and a second side contiguous and adjacent to the gripping portion 35*a*. The first side of the fourth folding portion 39*a* is opposite to the second side of the fourth folding portion 39*a*. In the embodiment, the third folding portion 38*a* and the fourth folding portion 39*a* are glued together by glue disposed therebetween. The first side of the third folding portion 38*a* is horizontal. The first side of the fourth folding portion 39*a* and the second side of the third folding portion 38*a* are slanted. The third folding portion 38*a* and the fourth folding portion 39*a* are contiguous to each other. The third folding portion 38*a* includes an end contiguous to an end of the fourth folding portion 39*a*. Each of a thickness of the third folding portion 38*a* and a thickness of the fourth folding portion 39*a* is not thicker than the thickness of the gripping portion 35*a*. The third folding portion 38*a* and the fourth folding portion 39*a* overlap with each other.

The slip-proof tape 30*a* is spirally wrapped on the middle 43*a* of the racket 40*a* with the inner face 31*a* facing inward and disposed on the middle 43*a*. The slip-proof tape 30*a* is mounted around an outer periphery of the racket 40*a*. A portion of the outer face 32 forms the rear end 33*a* of the slip-proof tape 30*a*. The rear end 33*a* of the slip-proof tape 30*a* abuts the rear end 41*a* of the rear racket 40*a* by the outer face 32*a*. The rear end 33*a* of the slip-proof tape 30*a* does not overlap with the rear end 33*a*. A maximum width of the rear end 33*a* of the slip-proof tape 30*a* in the diametric direction is smaller than the maximum width of the rear end 33*a* in the diametric direction. A portion of the outer face 32*a* forms the front end 34*a* of the slip-proof tape 30*a*. The front end 34*a* of the slip-proof tape abuts the front end 42*a* by the outer face 32*a*. The front end 34*a* of the slip-proof tape 30*a* does not overlap with the front end 34*a*. A maximum width of the front end 34*a* of the slip-proof tape 30*a* in the diametric direction is smaller than the maximum width of front end 34 in the diametric direction.

In view of the foregoing, the slip-proof grip coverings 10 and 10*a* are, thus, produced without an edge sealing procedure and do not have burrs on edges. Further, the slip-proof tapes 30 and 30*a* are simple in structure and are easy to process, effectively reducing the processing time.

Although specific embodiments have been illustrated and described, numerous modifications and variations are still possible without departing from the scope of the invention. The scope of the invention is limited by the accompanying claims.

The invention claimed is:

1. A slip-proof grip covering comprising:

a slip-proof tape having a rear end and a front end, wherein the slip-proof tape, along a longitudinal direction thereof, includes a gripping portion between the rear end and the front end and an end portion which is folded and includes a first and second folding portion adjacent to the rear end, wherein the first folding portion is folded on the second folding portion in the longitudinal direction of the slip-proof tape, wherein the first folding portion has a first side and a second side opposite to the first side and the second folding portion includes a first side attached to the second side of the first folding portion and a second side contiguous and adjacent to the gripping portion, and wherein each of the first and second folding portions has a thickness not thicker than a thickness of the gripping portion;

wherein the slip-proof tape has an inner face and an outer face, wherein a portion of the inner face and a portion of the outer face respectively form a first side and a second side of the gripping portion, and wherein the second side of the second folding portion is contiguous to the second side of the gripping portion, and wherein the first side of the first folding portion and the first side of the gripping portion are horizontal, and wherein the first side of the second folding portion and the second side of the first folding portion are slanted.

2. The slip-proof grip covering as claimed in claim 1, wherein the slip-proof tape, along the longitudinal direction thereof, includes another end portion which is folded and includes a third folding portion and a fourth folding portion adjacent to the front end, wherein the third folding portion is folded on the fourth folding portion in the longitudinal direction of the slip-proof tape, wherein the third folding portion has a first side and a second side opposite to the first side and the fourth folding portion includes a first side attached to the second side of the third folding portion and a second side contiguous and adjacent to the gripping portion, and wherein each of the third folding portion and the fourth folding portion is not thicker than the thickness of the gripping portion.

3. The slip-proof grip covering as claimed in claim 1, wherein the second side of the first folding portion and the first side of the second folding portion are glued together by glue disposed therebetween.

4. A slip-proof grip covering comprising:

a slip-proof tape having a rear end and a front end, wherein the slip-proof tape, along a longitudinal direction thereof, includes a gripping portion between the rear end and the front end and an end portion which is folded and includes a first and second folding portion adjacent to the rear end, wherein the first folding portion is folded on the second folding portion in the longitudinal direction of the slip-proof tape, wherein the first folding portion has a first side and a second side opposite to the first side and the second folding portion includes a first side attached to the second side of the first folding portion and a second side contiguous and adjacent to the gripping portion, and wherein each of the first and second folding portions has a thickness not thicker than a thickness of the gripping portion, wherein the slip-proof tape, along the longitudinal direction thereof, includes another end portion which is folded and includes a third folding portion and a fourth folding portion adjacent to the front end, wherein the third folding portion is folded on the fourth folding portion in the longitudinal direction of the slip-proof tape, wherein the third folding portion has a first side and a second side opposite to the first side and the fourth folding portion includes a first side attached to the second side of the third folding portion and a second side contiguous and adjacent to the gripping portion, and wherein each of the third and fourth folding portion is not thicker than the thickness of the gripping portion, wherein the slip-proof tape has an inner face and an outer face, wherein a portion of the inner face and a portion of the outer face respectively form a first side and a second side of the gripping portion, wherein the second side of the second folding portion is contiguous to the second side of the gripping portion, and wherein the second side of the fourth folding portion is contiguous to the second side of the gripping portion, and wherein the first sides of the first folding portion and the gripping portion are horizontal, wherein the first side of the second folding portion and the second side of the first folding portion are slanted, wherein the first side of the third folding portion and the first side of the gripping portion are horizontal, and wherein the first side of the fourth folding portion and the second side of third folding portion are slanted.

5. The slip-proof grip covering as claimed in claim 4, wherein the second side of the first folding portion and the first side of the second folding portion are glued together by glue disposed therebetween, and wherein the second side of the third folding portion and the first side of the fourth folding portion are glued together by glue disposed therebetween.

* * * * *